United States Patent [19]

Turner

[11] 3,933,613

[45] Jan. 20, 1976

[54] ELECTRODE FIXTURE FOR PLATING BATH

[75] Inventor: Dennis Robert Turner, Chatham Township, Morris County, N.J.

[73] Assignee: Bell Telephone Laboratories, Incorporated, Murray Hill, N.J.

[22] Filed: Dec. 27, 1974

[21] Appl. No.: 536,736

[52] U.S. Cl. ..... 204/242; 204/286; 204/292; 204/297 R; 204/297 W

[51] Int. Cl.[2] ..... C25D 17/10; C25D 17/00

[58] Field of Search... 204/286, 292, 297 R, 297 W, 204/242

[56] References Cited

UNITED STATES PATENTS

| | | | |
|---|---|---|---|
| 1,427,876 | 9/1922 | Weeks | 204/242 |
| 2,346,386 | 4/1944 | Naukervis | 204/297 W |
| 2,616,845 | 11/1952 | Kreml | 204/242 |
| 2,833,710 | 5/1958 | Mielke | 204/286 |
| 3,719,578 | 3/1973 | Berthoux et al. | 204/252 |
| 3,726,781 | 4/1973 | Verneuil | 204/286 |

FOREIGN PATENTS OR APPLICATIONS

| | | | |
|---|---|---|---|
| 37,362 | 6/1964 | Germany | 204/213 |

*Primary Examiner*—F. C. Edmundson
*Attorney, Agent, or Firm*—W. G. Nilsen

[57] ABSTRACT

Electroplating procedures and apparatus are described in which the metal plated out of the bath is replenished by a consumable anode. Particular attention is paid to the design of the anode assembly so as to facilitate rapid replenishment of the consumable part of the anode without introducing electrical resistances which results in nonuniform plating.

5 Claims, 3 Drawing Figures

ELECTRODE FIXTURE FOR PLATING BATH

BACKGROUND OF THE INVENTION

1. Field of the Invention

The invention involves a process and apparatus for the electroplating of metals. In particular, it involves electroplating utilizing a consumable anode.

2. Description of the Prior Art

Electroplating of metals such as, for example, copper and nickel is extensively used in the manufacture of various articles and devices. Well known is the plating of metals on iron and other metals to prevent corrosion and to increase conductivity. Recent developments include electroplating of metals in the manufacture of electronic circuits and devices. In these latter applications a considerable degree of control is required in order to obtain uniform and reproducible results.

A particular problem associated with electroplating is corrosion of various electrical connections used in the process. Particularly troublesome is the variation in current densities caused by corrosion in electrical contacts.

A particular case in point involves electroplating processes in which the plating metal is replenished using a consumable anode. Here, part of the anode assembly (called the consumable part of the anode) is made of the metal being plated and is dissolved by electrolytic action during the plating process. In order to facilitate resupply of this metal, the consumable part of the anode is usually made replaceable. Electrical contact between the consumable part of the anode and the anode rod is made through a hanging device called here an anode hook. The anode rod is connected to the electrical power supply. Conventionally, anode hooks are made from round stock in the form of hooks or eyes and are threaded into the consumable part of the anode. These hooks are hung on the anode rod. Usually, there is a multiplicity of anode hooks (with attached plating metal) hung on each anode rod and sometimes a number of anode rods in each anode assembly. In commercial manufacturing procedures where large plating tanks are run on a semi-continuous basis, a rapid and convenient procedure for replenishing the consumable part of the anode is highly desirable. In copper plating, the anode hook is sometimes made of titanium, but the anode rod is usually made of copper. Other materials either were not believed to have sufficiently high electrical conductivity, or presented the danger of contaminating the electroplating bath. Although titanium anode hooks and copper anode rods perform reasonably well, considerable care must be taken to insure that corrosion does not lead to alteration of the electrical resistance in the contacts which would produce nonuniform current distributions. This leads to considerable inconvenience in replenishing the consumable part of the anode. The consumable part of the anode is often made in the form of metal bars with the anode hooks threaded into the bars. As the metal dissolves, the threads which hold the bars on the hooks dissolves. This increases the electrical resistance between hook and metal bars and leads to nonuniform plating. In severe cases, the metal bar becomes electrically isolated so that no current flows. To prevent these conditions, the metal bars had to be removed much before complete dissolution.

SUMMARY OF THE INVENTION

The invention is a process and apparatus for electroplating metals in which titanium is used in certain crucial electrical parts which carry current to the electroplating bath. The invention pertains to electroplating processes in which a consumable anode is used to replenish metal plated out of the bath. The electrical parts involved are the anode rod which is attached to the source of current and the anode hook. The anode hook mechanically and electrically connects the consumable part of the anode to the anode rod. The anode hook is of unique design so as to permit rapid replacement of the consumable part of the anode without the danger of introducing excessive electrical resistance which might lead to nonuniform plating. Flat-stock titanium is used to make the anode hook. Viewed from the side, the anode hook has an L shape. The bottom surface of the L shape attaches to the consumable part of the anode. The flat part of the long section of the L shape (either inside or outside surface) attaches to the anode rod. The anode rod is also made of titanium flat stock with sufficient cross-section to insure a large area contact between anode rod and anode hook. This assures a low voltage drop at currents used in the plating process. The cross-section is approximately rectangular in shape with the longer-dimension surface attaching to the anode hook. A bolt (typically made of titanium with a shape so that it can be hand tightened) is threaded into this longer-dimension surface of the anode rod. The long section of the anode hook is slotted in the upward direction so that the anode hook hangs on the bolt threaded into the anode rod. Tightening of the bolt provides a positive contact between anode hook and anode rod. Because the contact between anode rod and anode hook is a flat surface with area generally greater than one inch square, the electrical resistance is very low and does not adversely affect the plating process. The consumable part of the anode, usually in the form of a metal bar with one flat surface, is attached to the bottom surface of the anode hook by means of a bolt (typically titanium) threaded into the metal bar. The flat interface between anode hook and metal bar tends to exclude electrolyte from the threads in the metal bar. Since electrolyte is not in contact with the threads, the threads are not dissolved and good mechanical and electrical contact are maintained between anode hook and metal bar during the plating process. The anode hook and rod made in accordance with the invention permits rapid replacement of the metal bars without the danger of introducing high resistance contacts which causes nonuniform plating.

DETAILED DESCRIPTION

Figure 1:
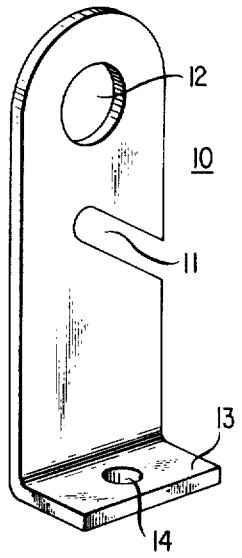
FIG. 1 is a perspective view of the titanium anode hook.

Interest in the use of titanium in electroplating devices was attracted by the discovery that ordinary commercially available titanium has a resistivity considerably lower than commonly known. For example, the literature value of commercial titanium as given in the standard reference [*Handbook of Tables for Applied Engineering Science*, edited by R. Bolz and G. L. Tuve, p. 95, the Chemical Rubber Company, Cleveland, Ohio (1970)] is 80 microhm-cm. Experiments carried out on commercial titanium show that the resistance is considerably less than 80 microhm-cm. This was determined by measuring the resistance of two rectangular pieces of titanium obtained from Industrial Titanium Corporation. One was 12 inches long by 2 inches wide and 3/16 inches thick, and the other was 24 inches long by 1½ inches wide and 5/16 inches thick. Fifty amperes of current was passed through the bars while the voltage drop between measured distances along the bars was determined with a high impedance input resistance digital voltmeter. The resistivity values were obtained from the formula $$\rho = \frac{RA}{l}$$

where $R$, the resistance, is equal to voltage drop divided by 50 amperes. $A$ is the cross-sectional area, and $l$ is the length between voltmeter probes. The resistivity values obtained for the two bars were 47.3 and 50.8 microhm-cm. The surprisingly lower resistivity value made it appear that titanium might be attractive for use in certain metal plating applications where freedom from corrosion and contamination considerations were of particular importance.

The invention is a process for the electrodeposition of metals in which certain critical parts in the anode assembly are made of commercial titanium. The invention is directed in particular to electrodeposition processes in which the metal being electroplated is replenished in the bath by a consumable anode. The anode assembly consists of an anode rod which is connected directly to the power supply, an anode hook and the consumable part of the anode. The consumable part of the anode is usually in the form of a metal bar preferable with at least one flat surface. The anode hook mechanically and electrically connects the anode rod to the metal bar.

The anode rod is preferably rectangular in cross-section so as to supply a flat surface for electrical connection to the anode hook. Cross-sectional dimensions may vary over wide limits, but a thickness of one-eighth inch to 1 inch and a width of 1–3 inches are typical. Dimensions are adjusted so as to provide sufficient surface for good electrical contact between anode rod and anode hook and to insure a small (preferably less than 0.1 volt) voltage drop in the anode rods at the current at which the plating process is carried out. The anode hook also is made of flat stock titanium and when viewed from the side is L-shaped. Along the flat surface of the long side of the L shape, it is slotted slightly in the upward direction so that the anode hook (with attached metal) can be slipped on a bolt attached to the anode rod. The anode hook is supplied with a hole on top of the L section for ease of grasping either by hand or by mechanical means. The bottom surface of the L shape is also flat and attaches to the flat surface of the metal bar. This attachment is usually made by means of a bolt screwed into a threaded hole in the metal bar. The advantage of a flat surface between the anode hook and the metal bar is that it tends to exclude electrolyte from the theaded hole which prevents dissolution of the threads. Also, the flat surfaces present a large area for electrical contact which minimizes electrical resistance. Typically, the anode hook is made of flat stock ⅛–1 inch thick and 1–3 inches wide. The length of the small part of the L shape is typically 1–3 inches, and the length of the long part of the L shape is typically 3–10 inches. Although this process is applicable to a large variety of plating processes, it is particularly significant in copper plating processes since these processes often replenish dissolved metal by anode dissolution. Further, copper plating baths are often quite corrosive and typically require high currents.

FIG. 1 shows a typical design of the anode hook 10 showing the upward slotted section 11 and the hole on top of the L shape 12, the bottom L section 13, and the hole required for attachment to the metal bar 14.

Figure 2:
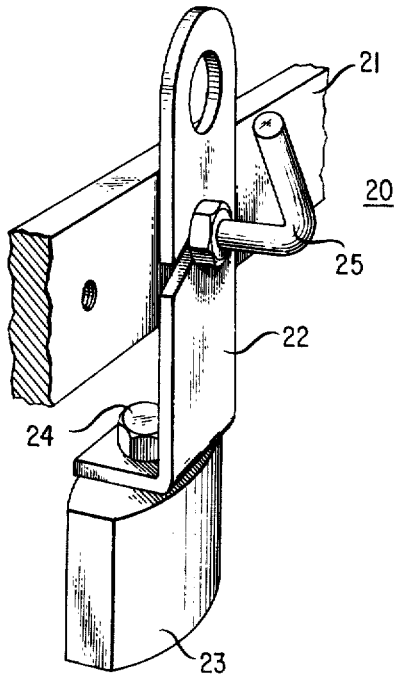
FIG. 2 shows a perspective view of the titanium anode hook attached to a section of anode rod and equipped with a copper metal bar.

FIG. 2 shows the assembled anode structure 20, with anode rod 21 made of titanium, anode hook 22 made of titanium and the metal bar 23. In a copper plating bath the metal bar is made of copper. Also shown is the screw 24 attached to the metal bar, which preferably is made of titanium. On attaching the anode hook to the anode rod, positive pressure is applied by a hand-tightened screw assembly 25. This positive pressure insures good electrical contact between the titanium anode rod and titanium anode hook.

Figure 3:
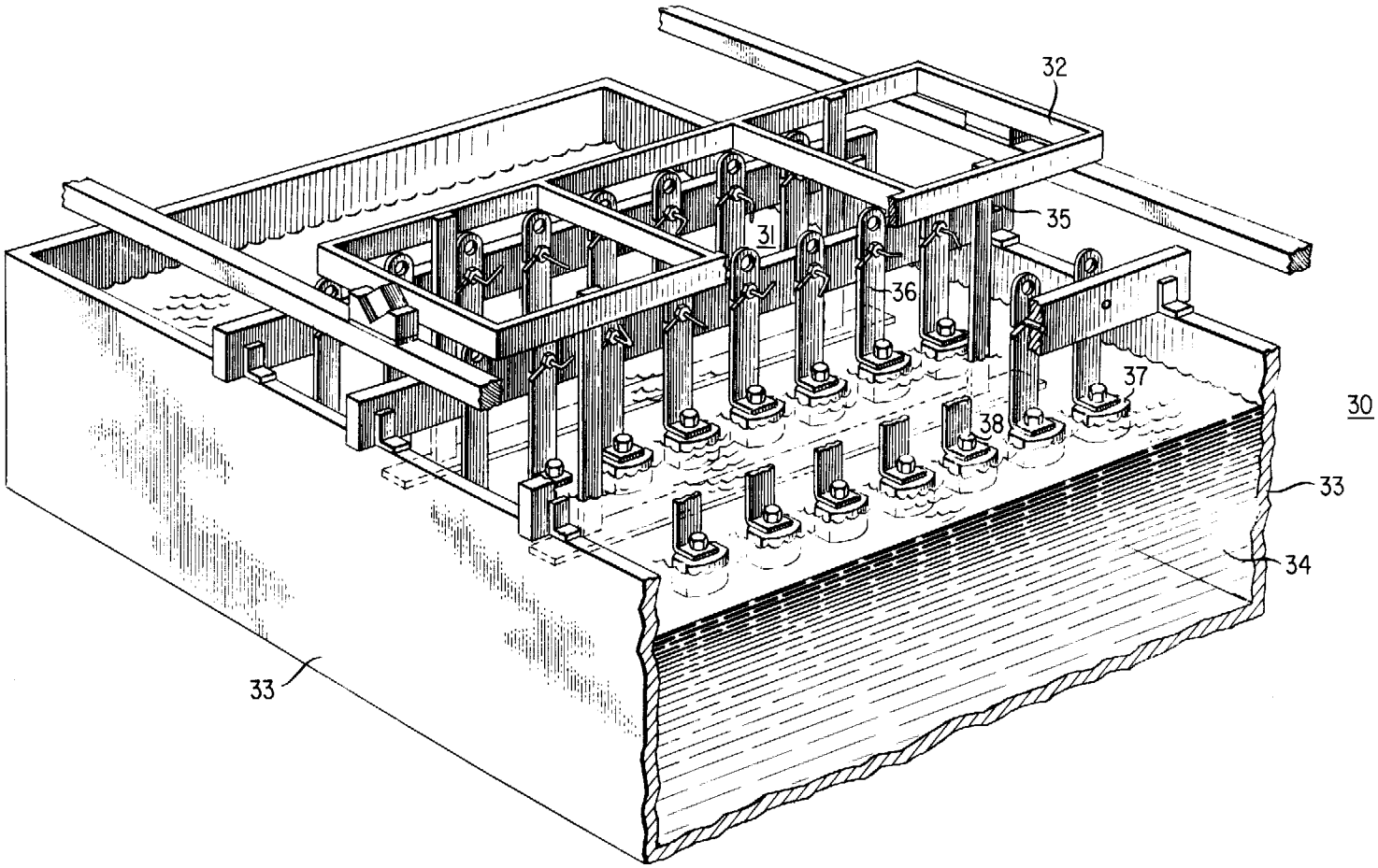
FIG. 3 shows a perspective view of a metal electroplating bath showing electrolyte, titanium anode hook and titanium anode rod.

FIG. 3 shows a perspective view with cutaway sections of an electroplating bath 30 with anode assembly 31 and cathode assembly 32. Also shown is the bath container 33 and bath solution 34. The anode assembly comprises the anode rod 35 and the anode hook 36. The metal being dissolved in the bath 37 and bolt 38 attaching this metal to the anode hook are also shown.

What is claimed is:

1. A cell for electroplating metals on a surface having an anode assembly and cathode assembly in which the anode assembly comprises an anode rod, an anode hook attached to the anode rod, means for attaching the anode hook to the anode rod, a consumable anode, and means for attaching the consumable anode to the anode hook, characterized in that the anode rod and anode hook are made of a flat stock material which consists essentially of titanium and the anode rod has a width between 1 and 3 inches and a thickness between one-eighth and 1 inch; and the anode hook has a width between 1 and 3 inches and a thickness between one-eighth and 1 inch and has an L shape with the short dimension of the L shape between 1 and 3 inches and the long dimension of the L shape between 3 and 12 inches and in which the long part of the L shape has a slot of uniform width slanting inwardly and upwardly for attachment to the anode rod.

2. The apparatus of claim 1 in which the electroplating metal is copper.

3. The apparatus of claim 1 in which the electroplating metal is nickel.

4. The apparatus of claim 1 in which the means of attaching the consumable anode to the anode hook is a bolt screwed into a threaded hole in the consumable anode in which the bolt is made of a material consisting essentially of titanium.

5. The apparatus of claim 1 in which the means of attaching the anode hook to the anode rod is a bolt threaded into the anode rod which fits into the slot in the anode hook, in which the bolt is made of a material which consists essentially of titanium.

* * * * *